US008754318B2

(12) United States Patent
Mori

(10) Patent No.: US 8,754,318 B2
(45) Date of Patent: Jun. 17, 2014

(54) CYMBAL PICKUP AND STAND PROVIDED WITH THE SAME

(75) Inventor: Yoshiaki Mori, Shizuoka (JP)

(73) Assignee: Roland Corporation, Shizuoka (JP)

( * ) Notice: Subject to any disclaimer, the term of this patent is extended or adjusted under 35 U.S.C. 154(b) by 155 days.

(21) Appl. No.: 13/607,824

(22) Filed: Sep. 10, 2012

(65) Prior Publication Data

US 2013/0125735 A1 May 23, 2013

(30) Foreign Application Priority Data

Nov. 21, 2011 (JP) ..... 2011-253765

(51) Int. Cl.
*G10H 3/00* (2006.01)

(52) U.S. Cl.
USPC ..... 84/723; 84/730; 84/415

(58) Field of Classification Search
CPC ..... G10H 2220/525; G10H 2230/331; G10H 2230/321; G10H 3/10; G10H 3/00; Y10S 84/24; G10D 13/00; G10D 13/065; G10D 13/06; H01L 41/18; G10K 9/121
See application file for complete search history.

(56) References Cited

U.S. PATENT DOCUMENTS 5,262,585 A * 11/1993 Greene et al. ..... 84/645
6,417,434 B1 * 7/2002 Lao ..... 84/422.3
6,798,122 B1 * 9/2004 Howarth et al. ..... 310/344
7,323,632 B2 * 1/2008 Wachter ..... 84/730
2004/0016339 A1 * 1/2004 Yoshino et al. ..... 84/723
2005/0039593 A1 * 2/2005 Wachter ..... 84/730
2005/0145101 A1 * 7/2005 Yoshino ..... 84/723
2005/0145102 A1 * 7/2005 Susami ..... 84/735
2005/0150349 A1 * 7/2005 Susami ..... 84/299
2010/0294111 A1 * 11/2010 Carraro ..... 84/421
2012/0118130 A1 * 5/2012 Field ..... 84/730
2012/0234157 A1 * 9/2012 Liao ..... 84/421
2012/0318119 A1 * 12/2012 Coady ..... 84/422.3
2013/0098223 A1 * 4/2013 Coady et al. ..... 84/421
2013/0125735 A1 * 5/2013 Mori ..... 84/723
2013/0174711 A1 * 7/2013 Lin ..... 84/422.3

FOREIGN PATENT DOCUMENTS

JP 3639103 4/2005

* cited by examiner

*Primary Examiner* — Malon Fletcher
(74) *Attorney, Agent, or Firm* — Jianq Chyun IP Office

(57) ABSTRACT

A cymbal pickup is described, including a sensor detecting the vibration of the cymbal, and a sensor attaching part to which the sensor is attached. The cymbal has, through its center, a hole that allows a rod to be inserted through. The sensor attaching part includes: a first abutting part having a first insertion hole for pass of the rod, a second abutting part configured opposite to a side of the first abutting part and having a second insertion hole for pass of the rod, and an insertion part between the two abutting parts to maintain a separation distance between the opposite sides of the two abutting parts. The sensor is attached to a side of the first or the second abutting part. The cymbal pickup abuts the cymbal and is fixed together with the cymbal to detect its vibration while the rod is inserted through them.

17 Claims, 7 Drawing Sheets

CYMBAL PICKUP AND STAND PROVIDED WITH THE SAME

CROSS-REFERENCE TO RELATED APPLICATION

This application claims priority benefit of the Japanese Patent Application Serial No. 2011-253765, filed on Nov. 21, 2011. The entirety of the above-mentioned patent application is hereby incorporated by reference herein and made a part of this specification.

BACKGROUND

1. Field of the Invention

The invention relates to a cymbal pickup and a stand provided with the cymbal pickup. In particular, the invention relates to a cymbal pickup, which is capable of stably detecting the vibration caused by a hit on a cymbal while preventing a sensor therein from damage, and a stand provided with the cymbal pickup.

2. Description of the Related Art

It is known that the conventional cymbal pickup is equipped with a sensor to detect the vibration of a cymbal. The cymbal pickup is fixed abutting the cymbal. The cymbal pickup detects the vibration of the cymbal via the sensor and outputs to a sound source device an electrical signal corresponding to the detection result.

For example, Patent Document 1 discloses a technique about a percussion transducer 30 (cymbal pickup), in which a piezo element 28 (sensor) having a pair of washers 22a and 22b adhered to two sides thereof is coated with a protective coating 20 formed of rubber. When a spindle 50 (rod) is inserted through the percussion transducer 30 and the cymbal, a nut 42 (fastening member) is screwed and fastened on the spindle 50 to secure the cymbal and the percussion transducer 30 thereon.

RELATED ART

Patent Reference

[Patent Document 1] U.S. Pat. No. 7,323,632 (FIG. 1, FIG. 4, etc.)

Problem to be Solved by the Invention

However, in the conventional percussion transducer 30 described above, the pair of washers 22a and 22b may be pressed close to each other by a strong fastening force of the nut 42, which may compress the piezo element 28 positioned between the washers 22a and 22b and hinder its vibration thereof. That is, the fastening force of the nut 42 may affect the detection result of the piezo element 28. Therefore, the conventional technique faces the problem that the vibration caused by the hit on the cymbal cannot be stably detected. In addition, when the cymbal is strongly hit, the cymbal tilts relative to the spindle 50 and bends the percussion transducer 30. This may vary the separation distance between the washers 22a and 22b so that the piezo element 28 adhered to the washers is deformed. That is, the piezo element 28 is deformed as the cymbal tilts. Hence, the conventional technique also faces a problem that a strong hit on the cymbal may easily damage the piezo element 28.

SUMMARY OF THE INVENTION

Accordingly, the invention provides a cymbal pickup, which is capable of stably detecting the vibration caused by the hit on the cymbal while preventing the sensor therein from damage, and a stand provided with the cymbal pickup.

Solution to the Problem and Efficiency of the Invention

A cymbal pickup according to a $1^{st}$ item of the invention includes a sensor attaching part, which has a predetermined hardness and includes an insertion part to maintain the separation distance between a side of a first abutting part and a side of a second abutting part. Therefore, the first and the second abutting parts are prevented from being pushed close to each other by the fastening force of a fastening member. Moreover, the vibration of the sensor attached to the side of the first abutting part or the second abutting part is not hindered by the fastening force of the fastening member. That is, the detection result of the sensor is not affected by the fastening force. Accordingly, the sensor outputs the detection result corresponding to the vibration of the sensor attaching part as transmitted from the cymbal, and the vibration caused by the hit on the cymbal is stably detected.

The separation distance between the first and the second abutting parts is maintained by the insertion part. For this reason, the separation distance does not vary when the cymbal tilts relative to the rod, and the sensor attached to the side of the first abutting part or the second abutting part is not deformed as the cymbal tilts. Thus, the sensor is free from the damage caused by a strong hit on the cymbal.

In addition to the effects of the $1^{st}$ item, a cymbal pickup according to a $2^{nd}$ item of the invention further provides the following effects. The sensor attaching part is disposed between a first buffer part and a second buffer part. The first and second buffer parts respectively include a material with greater elasticity than the sensor attaching part. Therefore, when the rod is inserted into the cymbal pickup and the cymbal, the cymbal and the cymbal pickup can be secured firmly on the rod by screwing and fastening the fastening member on the rod.

In addition to the effects of the $2^{nd}$ item, a cymbal pickup according to a $3^{rd}$ item of the invention further provides the following effects. When the rod is inserted into the cymbal pickup, the first buffer part with less elasticity than the second buffer part is disposed on the side close to the cymbal, so as to inhibit the damping of the vibration transmitted from the cymbal to the sensor attaching part. Meanwhile, the second buffer part with greater elasticity than the first buffer part is disposed on the side close to the floor, so that the vibration transmitted from the floor to the second buffer part via the rod is reduced effectively.

As described above, when the cymbal pickup is fixed to the rod, the first buffer part with relatively less elasticity is disposed on the side close to the cymbal and the second buffer part with relatively greater elasticity disposed on the side close to the floor. Accordingly, the damping of the vibration transmitted from the cymbal to the sensor attaching part is inhibited, and the vibration transmitted from the floor to the sensor attaching part is reduced. Thereby, the vibration caused by the hit on the cymbal is easily and accurately transmitted to the sensor attaching part.

In addition to the effects of the $1^{st}$ item, a cymbal pickup according to a $4^{th}$ item of the invention further provides the following effects. The sensor attaching part is disposed between the first buffer part and a knob, and the first buffer part includes a material with greater elasticity than the sensor attaching part. Therefore, when the rod is inserted through the cymbal pickup and the cymbal, the cymbal and the cymbal pickup are firmly secured to the rod by screwing and fastening the knob to the rod.

Moreover, the cymbal and the cymbal pickup are fixed to the rod by screwing and fastening the knob to the rod in a state that the first abutting part abuts the top side of the cymbal. As compared to using an additional fastening member to fix the cymbal and the pickup to the rod, the fastening process of this item is simpler.

In addition to the effects of the $3^{rd}$ or $4^{th}$ item, a cymbal pickup according to a $5^{th}$ item of the invention further provides the following effects. When the rod is inserted through the cymbal pickup, the first buffer part abuts the cymbal, and the sensor attached to the first abutting part is positioned closer to the cymbal. Thus, the vibration transmitted from the cymbal to the sensor attaching part is more easily detected.

In addition to the effects of any one of the $2^{nd}$ to $5^{th}$ items, a cymbal pickup according to a $6^{th}$ item of the invention further provides the following effects. The first buffer part and the second buffer part or the knob are adhered to the sensor attaching part. Thus, the first buffer part and the second buffer part or the knob are prevented from sliding on the sensor attaching part. As a result, a problem that the sensor may detect the vibration of the sensor attaching part caused by the sliding of the first buffer part and the second buffer part or the knob is prevented.

In addition, the inner sidewall of a first axial hole of the first buffer part and the inner sidewall of a second axial hole of the second buffer part or the knob are positioned inward relative to the inner sidewall of a first insertion hole of the first abutting part and the inner sidewall of a second insertion hole of the second abutting part. When the rod is inserted, the inner sidewalls of the first axial hole of the first buffer part and the second axial hole of the second buffer part or the knob are closer to the rod than the inner sidewalls of the first insertion hole of the first abutting part and the second insertion hole of the second abutting part, which prevents the first abutting part and the second abutting part from abutting the rod. Accordingly, the vibration of the sensor attaching part, which occurs when the sensor attaching part abuts the rod, is prevented.

In addition to the effects of any one of the $2^{nd}$ to $6^{th}$ items, a cymbal pickup according to a $7^{th}$ item of the invention further provides the following effects. A protruding part is configured to protrude from at least one side of the first buffer part or the second buffer part or the knob to be inserted into the first insertion hole of the first abutting part or the second insertion hole of the second abutting part. Thus, when the rod is inserted, the protruding part is located between the rod and the first insertion hole of the first abutting part or the second insertion hole of the second abutting part, so as to prevent the first abutting part or the second abutting part from abutting the rod. Accordingly, the vibration of the sensor attaching part, which occurs when the sensor attaching part abuts the rod, is prevented.

In addition to the effects of any one of the $2^{nd}$ to $7^{th}$ items, a cymbal pickup according to an $8^{th}$ item of the invention further provides the following effects. The first buffer part includes a cymbal abutting surface having a spherical shape and formed on the side opposite to the surface that abuts the first abutting part. The cymbal abutting surface is fixed to the rod while abutting the cymbal, and a contact area between the cymbal and the first buffer part when the cymbal is hit is reduced. Therefore, even when the cymbal is hit and tilts, the contact between the cymbal and the first buffer part is maintained to effectively transmit the vibration of the cymbal to the sensor attaching part. In addition, the influence that the contact between the first buffer part and the cymbal may cause to the original sound of the cymbal is reduced to the minimum. Furthermore, deformation of the first buffer part, which results from the tilt of the cymbal, is inhibited, and sliding of the first buffer part on the sensor attaching part, which is caused by the deformation of the first buffer part, is inhibited as well. Accordingly, the vibration of the sensor attaching part that may occur when the first buffer part slides on the sensor attaching part is prevented.

In addition to the effects of any one of the $1^{st}$ to $8^{th}$ items, a cymbal pickup according to a $9^{th}$ item of the invention further provides the following effects. A hollow space is maintained between the first and the second abutting parts, allowing the sensor to vibrate without hindrance. Thus, the vibration caused by the hit on the cymbal is easily and accurately transmitted to the sensor attaching part.

A stand according to a $10^{th}$ item of the invention includes the cymbal pickup of any one of the $1^{st}$ to $9^{th}$ items and provides the same effects described above.

DESCRIPTION OF THE EMBODIMENTS

Exemplary embodiments of the invention are described below referring to the accompanying drawings. First, the schematic configuration of a cymbal stand 1 according to the first embodiment of the invention is explained referring to FIG. 1 that illustrates a perspective view of the cymbal stand 1 from an inclined upward angle.

Figure 1B:
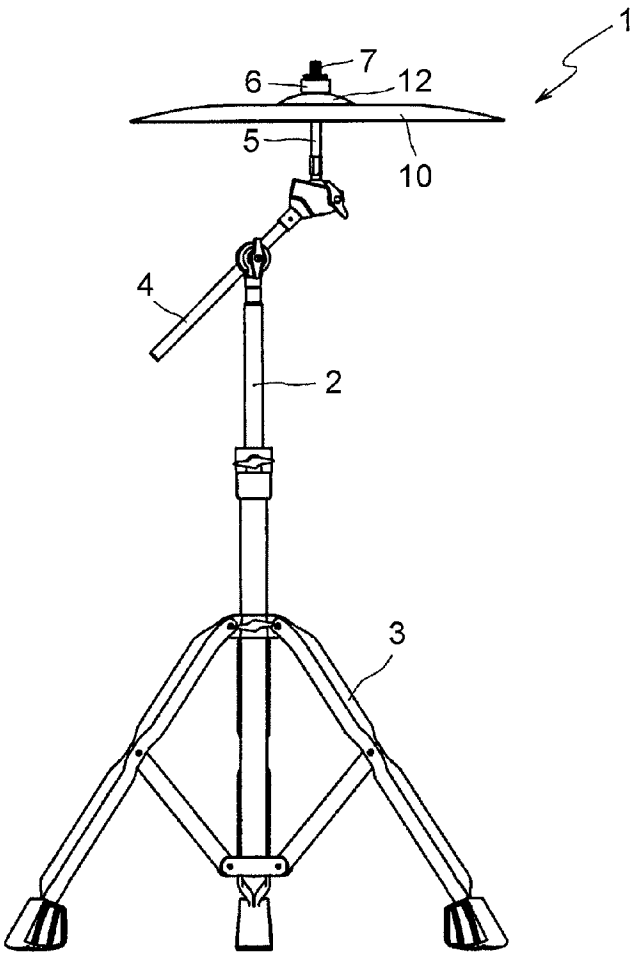
FIG. 1B is a front view of the cymbal stand according to the first embodiment of the invention.
Figure 1A:
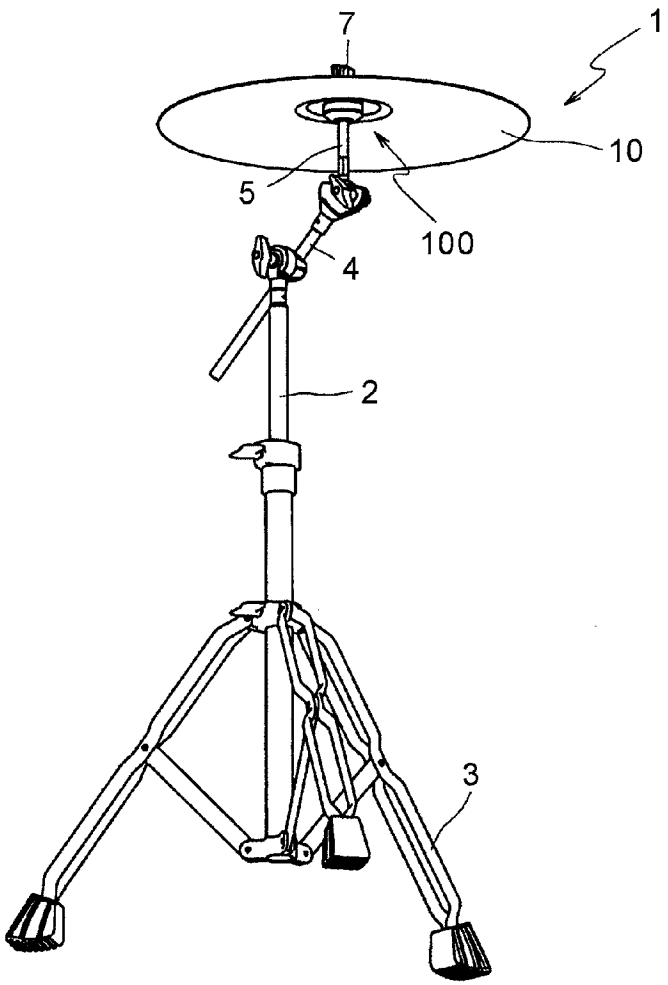
FIG. 1A is a perspective view of a cymbal stand according to a first embodiment of the invention.

As shown in FIGS. 1A-1B, the cymbal stand 1 is used for placing a cymbal 10 at a position desired by the player. The cymbal stand 1 mainly includes an extension pipe 2, legs 3, a support pipe 4, and a rod 5. The extension pipe 2 is extensible. The legs 3 support the extension pipe 2 on the floor. The support pipe 4 is supported by the extension pipe 2. The rod 5 is supported by the support pipe 4.

The rod 5 is a stick-shaped member that is formed to be inserted into a hole 11 (see FIG. 4) disposed through a center of the cymbal 10. The cymbal 10 is the so-called acoustic cymbal. The cymbal 10 is inserted through by the rod 5 in a state that a ring-shaped cushion material 6 made of felt abuts a top side of the cymbal 10 and a pickup 100 abuts a bottom side of the cymbal 10. Moreover, while the rod 5 is inserted, a fastening member 7 having a female thread is screwed and fastened onto an outer peripheral surface of a tip section of the rod 5, which has a male thread thereon, so as to fix the cushion material 6, the cymbal 10 and the pickup 100 to the rod 5.

Figure 2A:
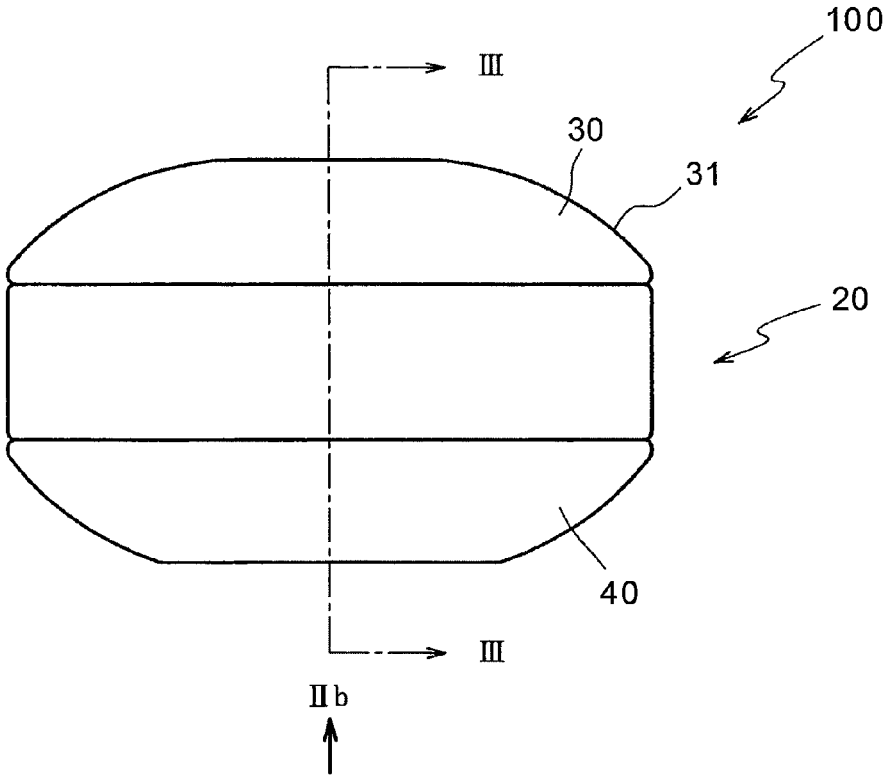
FIG. 2A is a front view of a pickup.
Figure 2B:
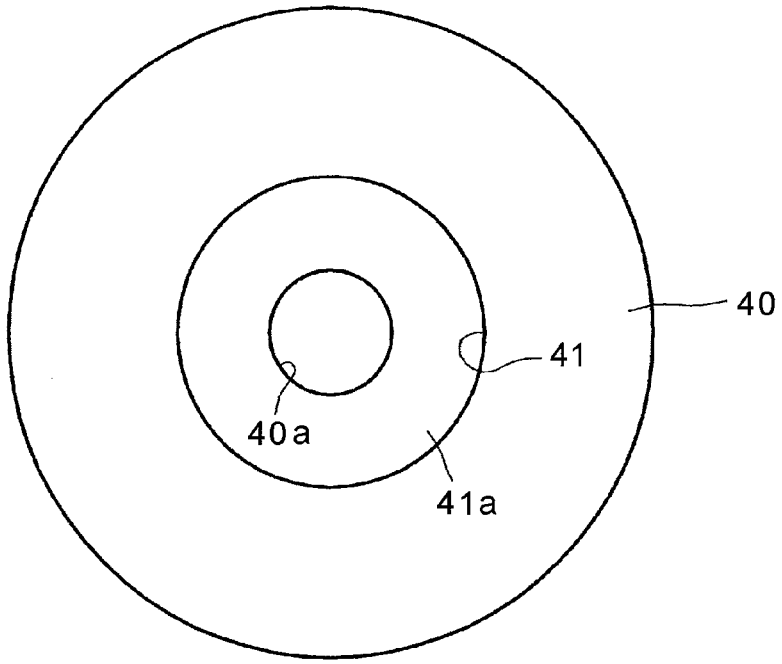
FIG. 2B is a bottom view of the pickup of FIG. 2A from the IIb direction.

Next, referring to FIGS. 2-4, a specific configuration of the pickup 100 is explained below. It is noted that a line that represents a cable 52 is omitted in FIGS. 2A-2B. FIGS. 4A-4B are cross-sectional views along an axial direction of the rod 5.

The pickup 100 is a device for detecting the hit on the cymbal 10 and outputting an electrical signal that corresponds to the hit on the cymbal 10 to a sound source device (not shown). As shown in FIGS. 2A-2B, the pickup 100 includes a sensor attaching part 20 formed into a cylindrical shape, a first buffer part 30, and a second buffer part 40. The first buffer part 30 is attached to a side of the sensor attaching part 20 (upper side of FIG. 2A) and is formed into a cylindrical shape. The second buffer part 40 is attached to another side of the sensor attaching part 20 (lower side of FIG. 2A) and is formed into a cylindrical shape. Herein, the sensor attaching part 20, the first buffer part 30, and the second buffer part 40 are disposed coaxially.

The sensor attaching part 20 is formed of an ABS resin. As shown in FIG. 3, the sensor attaching part 20 includes a first abutting part 21, a second abutting part 22 and an insertion part 23. The first abutting part 21 is formed into a ring shape. The second abutting part 22 is disposed opposite to the first abutting part 21 at a position apart from the first abutting part 21, and is formed into a ring shape. The insertion part 23 is inserted between the first abutting part 21 and the second abutting part 22. In this embodiment, the sensor attaching part 20 is formed of ABS resin, but a synthetic resin or a metal such as iron or bronze, which has a predetermined hardness, can also be used to form the sensor attaching part 20.

Figure 3:
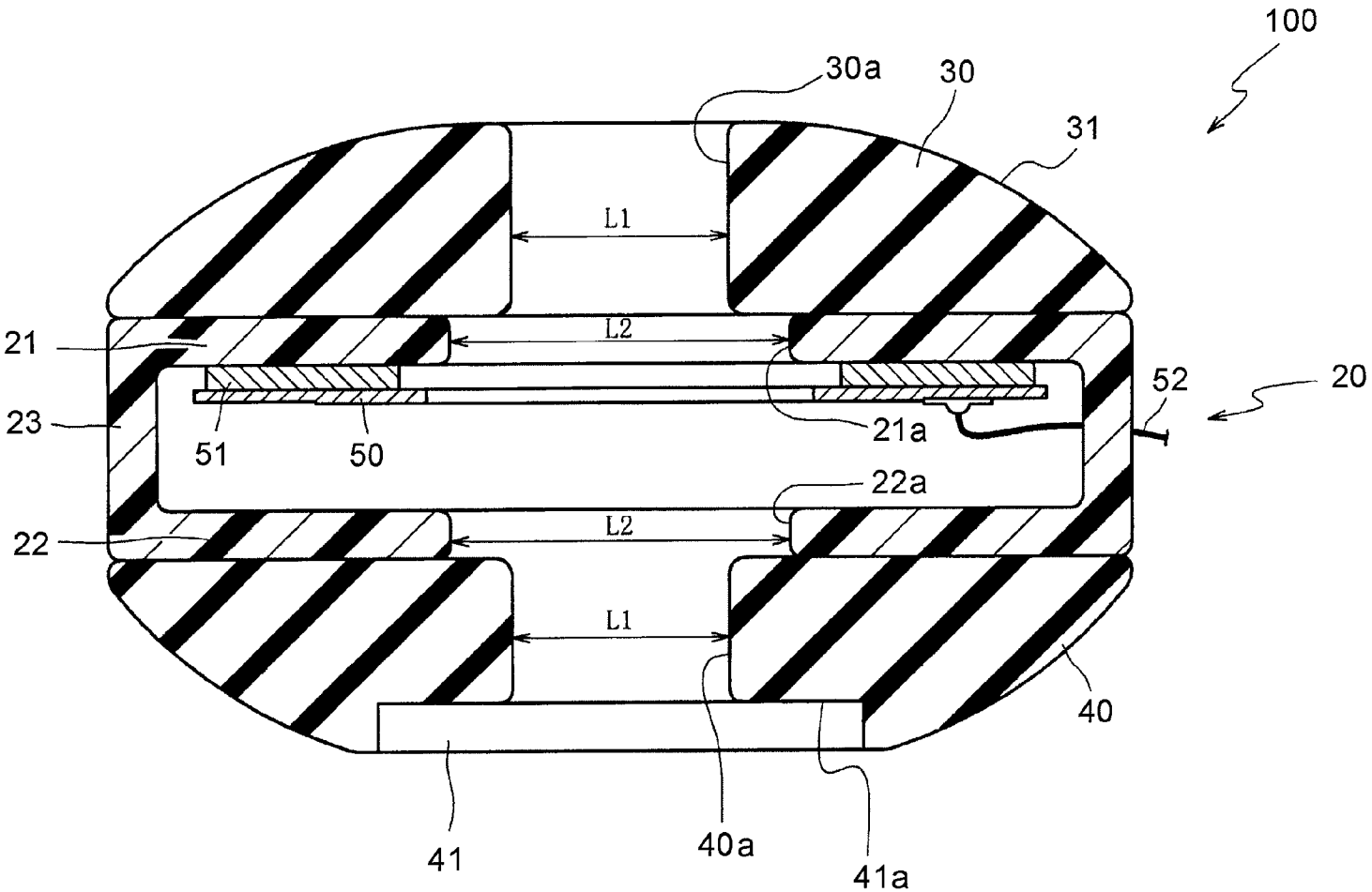
FIG. 3 is a cross-sectional view of the pickup of FIG. 2A along the III-III line.
Figure 4A:
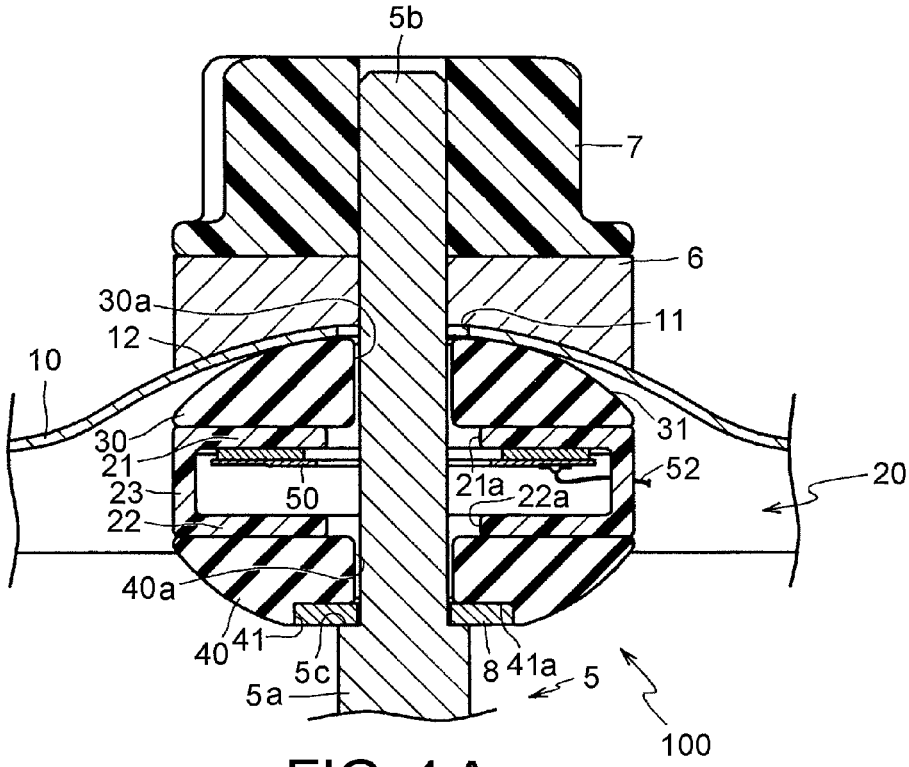
FIG. 4A is a partial cross-sectional view of a cymbal stand.
Figure 4B:
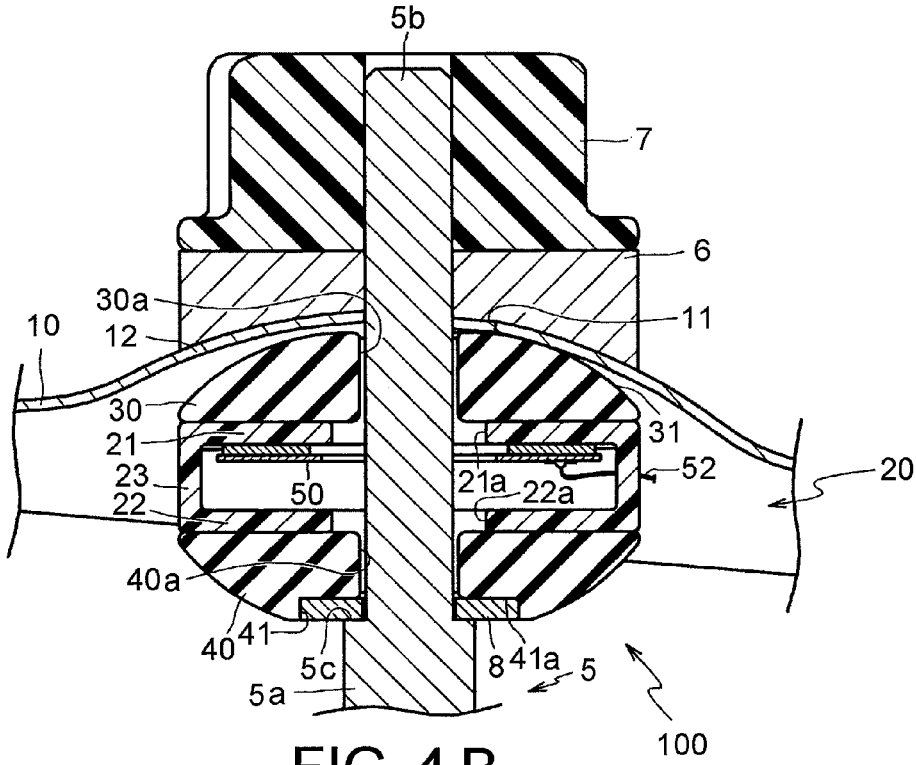
FIG. 4B is a partial cross-sectional view of the cymbal stand when the cymbal is in a tilt state.

The first abutting part 21 abuts the first buffer part 30 at the top side (the upper side of FIG. 3). The first abutting part 21 has a first insertion hole 21*a* therein. The first insertion hole 21*a* passes through the first abutting part 21 along the thickness direction (the vertical direction of FIG. 3) of the first abutting part 21. The first insertion hole 21*a* allows the rod 5 to pass through (see FIG. 4A) and is formed at a central section of the first abutting part 21.

The second abutting part 22 abuts the second buffer part 40 at the bottom side (lower side of FIG. 3). The second abutting part 22 has a second insertion hole 22*a* therein. The second insertion hole 22*a* passes through the second abutting part 22 along the thickness direction (vertical direction of FIG. 3) of the second abutting part 22. The second insertion hole 22*a* allows the rod 5 to pass through and is formed at a central section of the second abutting part 22. The first abutting part 21 and the second abutting part 22 have approximately the same shape. In addition, the first insertion hole 21*a* of the first abutting part 21 and the second insertion hole 22*a* of the second abutting part 22 are arranged coaxially.

The insertion part 23 is a cylindrical member which maintains a certain separation distance between the first abutting part 21 and the second abutting part 22. The entirety of the outer peripheral edge on the bottom side (lower side of FIG. 3) of the first abutting part 21 and the entirety of the outer peripheral edge on the top side (upper side of FIG. 3) of the second abutting part 22 are connected via the insertion part 23. Thereby, when a force is applied to push the first abutting part 21 and the second abutting part 22 close to each other, the separation distance between the first abutting part 21 and the second abutting part 22 is maintained by the insertion part 23.

A ring-shaped piezo sensor 50 is adhered to the bottom side of the first abutting part 21 via a double-sided tape 51, outputting an electrical signal to the sound source device (not shown) corresponding to the vibration transmitted from the sensor attaching part 20. An end of the cable 52 connected to the sound source device is attached to the piezo sensor 50. The cable 52 passes through a hole (not shown) formed through the insertion part 23. The other end of the cable 52 is disposed outside the sensor attaching part 20 to be connected with the sound source device. The inner diameter of the piezo sensor 50 is set larger than the inner diameter of the first insertion hole 21*a* of the first abutting part 21. In addition, the piezo sensor 50 and the first abutting part 21 are disposed coaxially. Because the piezo sensor 50 has a ring shape, the vibration of the cymbal 10 is stably detected no matter which part of the cymbal 10 (see FIG. 4A) is hit.

The inside of the sensor attaching part 20, i.e., the space surrounded by the first abutting part 21, the second abutting part 22 and the insertion part 23, is hollow. In addition, only the piezo sensor 50 and the double-sided tape 51 are disposed inside the sensor attaching part 20. Thus, no element is disposed between the piezo sensor 50 and the second abutting part 22 to hinder the vibration of the piezo sensor 50.

The sensor attaching part 20 is formed by bonding the first abutting part 21, the second abutting part 22 and the insertion part 23 to each other after adhering the piezo sensor 50 to the first abutting part 21. However, the sensor attaching part 20 can also be formed by bonding the first abutting part 21 to the insertion part 23 first, then adhering the piezo sensor 50 to the first abutting part 21, and bonding the second abutting part 22 to the insertion part 23 thereafter.

When the rod 5 is inserted into the pickup 100 (see FIG. 4A), the first buffer part 30 is inserted between the cymbal 10 and the sensor attaching part 20. The first buffer part 30 is formed of a relatively hard elastic material having greater elasticity than the sensor attaching part 20. A synthetic rubber with a hardness of 80 degrees (JIS K6253 Type A) for example is used as the elastic material for forming the first buffer part 30. The first buffer part 30 includes a first axial hole 30*a* and a cymbal abutting surface 31. The first axial hole 30*a* passes through the first buffer part 30 along the thickness direction (vertical direction of the FIG. 3) of the first buffer part 30. The cymbal abutting surface 31 forms the top side of the first buffer part 30.

The first axial hole 30*a* is formed to allow the rod 5 to pass through. The first buffer part 30 is adhered to the top side of the first abutting part 21 in a state that the first axial hole 30*a* and the first insertion hole 21*a* formed in the first abutting part 21 of the sensor attaching part 20 are arranged coaxially.

When the rod 5 is inserted into the pickup 100, the cymbal abutting surface 31 abuts the cymbal 10 (FIG. 4A) and has a spherical shape. The cymbal abutting surface 31 is positioned at the central section of the cymbal 10. Also, the cymbal abutting surface 31 has a curvature radius that is smaller than the curvature radius of a cup part 12 (see FIG. 4A) which has a spherical shape protruding from the bottom side toward the top side. Accordingly, when the cymbal 10 abuts the cymbal abutting surface 31, the contact area of the cymbal abutting surface 31 and the cymbal 10 is reduced.

When the rod 5 is inserted into the pickup 100, the second buffer part 40 is inserted between a washer 8 (see FIG. 4A) and the sensor attaching part 20. The second buffer part 40 is formed of an elastic material with greater elasticity than the first buffer part 30. A synthetic rubber with a hardness of 60 degrees (JIS K6253 Type A) or a felt with a density of 0.25 g/cm$^3$, for example, is used as the elastic material for forming the second buffer part 40. The second buffer part 40 includes:

a second axial hole 40*a* passing through the second buffer part 40 along its thickness direction (the vertical direction of the FIG. 3), and a washer receiving part 41 formed into the bottom side of the second buffer part 40.

The second axial hole 40*a* is formed allowing the rod 5 to pass through. The second buffer part 40 is adhered to the bottom side of the second abutting part 22 in a state that the second axial hole 40*a* and the second insertion hole 22*a* formed in the second abutting part 22 of the sensor attaching part 20 are arranged coaxially.

When the rod 5 is inserted into the pickup 100, the washer receiving part 41 receives the washer 8. The washer receiving part 41 includes a washer abutting surface 41*a* that forms the bottom side of the washer receiving part 41.

Herein, the inner diameter of the first axial hole 30*a* of the first buffer part 30 and the inner diameter of the second axial hole 40*a* of the second buffer part 40 are respectively set to a dimension L1, and the inner diameter of the first insertion hole 21*a* of the first abutting part 21 and the inner diameter of the second insertion hole 22*a* of the second abutting part 22 are respectively set to L2, wherein L1<L2. Thus, the inner sidewalls of the first axial hole 30*a* of the first buffer part 30 and the second axial hole 40*a* of the second buffer part 40 are positioned inward relative to the inner sidewalls of the first insertion hole 21*a* of the first abutting part 21 and the second insertion hole 22*a* of the second abutting part 22.

The dimension L1 may be set greater than the outer diameter of the rod 5, and may alternatively be set smaller than the outer diameter of the rod 5 but allowing the rod 5 to be pushed into the first axial hole 30*a* and the second axial hole 40*a*. In cases where the dimension L1 is greater than the outer diameter of the rod 5, the rod 5 is prevented from abutting the inner sidewalls of the first axial hole 30*a* and second axial hole 40*a* when the rod 5 is inserted into the pickup 100, which reduces the wear of the inner sidewalls of the first axial hole 30*a* and the second axial hole 40*a*. On the other hand, in cases where the dimension L1 is smaller than the outer diameter of the rod 5 and the rod 5 has to be pushed into the first axial hole 30*a* and the second axial hole 40*a*, the outer peripheral surface of the rod 5 is held by the inner sidewalls of the first axial hole 30*a* and the second axial hole 40*a* when the rod 5 is inserted into the pickup 100. Accordingly, the pickup 100 is tightly fixed to the rod 5.

As shown in FIG. 4A, the rod 5 includes a large-diameter part 5*a*, a small-diameter part 5*b*, and a connection surface 5*c*. The large-diameter part 5*a* forms a lower part of the rod 5 and is supported by the support pipe 4 (see FIG. 1). The small-diameter part 5*b* forms an upper part of the rod 5 and has a diameter smaller than the diameter of the large-diameter part 5*a*. The connection surface 5*c* connects the large-diameter part 5*a* and the small-diameter part 5*b* and is perpendicular to the axial direction (the vertical direction of FIG. 4A) of the rod 5. Moreover, a male thread, which matches the female thread formed inside the fastening member 7, is formed on the outer peripheral surface of a tip section (the upper section of FIG. 4A) of the small-diameter part 5*b*.

The washer 8 is a ring-shaped member formed of a metal material. The inner diameter of the washer 8 is smaller than the outer diameter of the large-diameter part 5*a* of the rod 5 but greater than the outer diameter of the small-diameter part 5*b*. Thus, as the tip section of the small-diameter part 5*b* of the rod 5 is inserted into the washer 8, the rod 5 is blocked by the washer 8 that abuts the connection surface 5*c* of the rod 5.

The rod 5 is inserted into the pickup 100 in a manner that the washer 8 penetrated by the rod 5 faces toward the washer receiving part 41 of the second buffer part 40. Herein, by confirming the position of the washer receiving part 41 of the second buffer part 40, the orientation of the pickup 100 relative to the rod 5 can be easily determined.

When the rod 5 is inserted into the pickup 100, the washer 8 is received by the washer receiving part 41 and abuts the washer abutting surface 41*a*. Since the washer abutting surface 41*a* has an even surface, the pickup 100 can be easily maintained in a level state. Thus, the pickup 100 can be easily fastened in a level state. That is, the process of fastening the pickup 100 to the rod 5 can be simplified.

After being inserted into the pickup 100, the rod 5 passes through the hole 11 of the cymbal 10, and the cymbal abutting surface 31 of the first buffer part 30 abuts the cymbal 10. Also, after the rod 5 passes through the cymbal 10, the rod 5 passes through the cushion material 6 to be screwed and fastened by the fastening member 7. As a result, the cymbal 10 and the pickup 100 are fixed to the rod 5.

Herein, the pickup 100 is configured in a way that the second buffer part 40 with greater elasticity than the first buffer part 30 is on the side closer to the floor. Thus, the vibration transmitted from the floor to the second buffer part 40 via the rod 5 and the washer 8 can be easily reduced, and the vibration transmitted from the floor to the sensor attaching part 20 can be decreased. Hence, detection of the vibration from the floor to the sensor attaching part 20 by the piezo sensor 50 is inhibited.

Moreover, the sensor attaching part 20 is disposed between the first buffer part 30 with greater elasticity than the sensor attaching part 20 and the second buffer part 40 with greater elasticity than the first buffer part 30. The first buffer part 30 and the second buffer part 40 are elastically deformable when compressed by the fastening force of the fastening member 7. Therefore, the elastic restoring forces of the first buffer part 30 and the second buffer part 40 can be used to fix the cymbal 10 and the pickup 100 to the rod 5 firmly. Thus, a problem that the sensor 50 attached to the sensor attaching part 20 may detect a sliding sound caused by the cymbal 10 or the rod 5 and the pickup 100 is prevented.

Herein, the sensor attaching part 20 is formed of the ABS resin and thus has a predetermined hardness, and the separation distance between the first abutting part 21 and the second abutting part 22 is maintained by the insertion part 23. Thus, the first abutting part 21 and the second abutting part 22 are kept from being pushed close to each other when fastened by the fastening member 7. Thus, the vibration of the piezo sensor 50 attached to the bottom side of the first abutting part 21 can be free from hindrance that results from the fastening of the fastening member 7. That is to say, a problem that the detection result of the piezo sensor 50 may be affected by the fastening force of the fastening member 7 is prevented. Thus, the piezo sensor 50 can output the detection result corresponding to the vibration of the sensor attaching part 20 transmitted from the cymbal 10. That is, the vibration caused by the hit on the cymbal 10 can be stably detected. Moreover, the player can set the tone and the swing, etc. of the cymbal 10 as he/she desires for the performance by adjusting the fastening of the fastening member 7.

In addition, the first buffer part 30 and the second buffer part 40 are respectively adhered to the first abutting part 21 and the second abutting part 22 of the sensor attaching part 20. Moreover, the inner sidewalls of the first axial hole 30*a* of the first buffer part 30 and the second axial hole 40*a* of the second buffer part 40 are positioned inward relative to the inner sidewalls of the first insertion hole 21*a* of the first abutting part 21 and the second insertion hole 22*a* of the second abutting part 22. Because of these, the inner sidewalls of the first axial hole 30*a* and the second axial hole 40*a* are closer to the rod 5 than the inner sidewalls of the first insertion hole 21*a* and the second insertion hole 22*a*. Thus, when the rod 5 moves in a circumferential direction relative to the pickup 100, the first buffer part 30 or the second buffer part 40 can abut against the rod 5. This prevents the first abutting part 21 and the second abutting part 22 from abutting the rod 5. Thereby, a problem that the piezo sensor 50 may detect the vibration of the sensor attaching part 20 occurring when the sensor attaching part 20 abuts the rod 5 is prevented.

Furthermore, because the inner diameter of the piezo sensor 50 is set greater than the inner diameter of the first insertion hole 21*a* of the first abutting part 21, contact between the piezo sensor 50 and rod 5 is also prevented.

On the other hand, the cymbal abutting surface 31 of the first buffer part 30 of the pickup 100 positioned at the lower side of the cymbal 10, which abuts the cymbal 10, has a spherical shape. Thus, the contact area between the cymbal 10 and the cymbal abutting surface 31 is reduced. For this reason, when the cymbal 10 is hit and tilts, the cymbal 10 and the first buffer part 30 can remain in contact and the vibration of the cymbal 10 can be accurately transmitted to the sensor attaching part 20. In addition, the influence that the contact between the first buffer part 30 and the cymbal 10 causes to the original sound of the cymbal 10 can be minimized. Further, the elastic deformation of the first buffer part 30 caused by the tilt of the cymbal 10 can be inhibited. Thus, the sliding of the first buffer part 30 on the sensor attaching part 20 when the first buffer part 30 is deformed can be inhibited. In addition, the first buffer part 30 and the second buffer part 40 are respectively adhered to the first abutting part 21 and the second abutting part 22 of the sensor attaching part 20, so that the first buffer part 30 and the second buffer part 40 are prevented from sliding on the sensor attaching part 20. Thus, a problem that the piezo sensor 50 may detect the vibration of the sensor attaching part 20 resulting from the sliding of the first buffer part 30 and the second buffer part 40 is prevented.

For the first buffer part 30 is formed of an elastic material that is relatively hard and has less elasticity than the second buffer part 40, the vibration transmitted from the cymbal 10 to the sensor attaching part 20 can be prevented from being attenuated by the first buffer part 30. Therefore, the vibration caused by the hit on the cymbal 10 can be easily and accurately transmitted to the sensor attaching part 20.

In the sensor attaching part 20, the first abutting part 21 that abuts the first buffer part 30 is disposed close to the cymbal 10, and the piezo sensor 50 is adhered to the first abutting part 21. As compared to the case of adhering the piezo sensor 50 to the second abutting part 22, the piezo sensor 50 is disposed at a position closer to the cymbal 10. Therefore, the piezo sensor 50 can easily and accurately detect the vibration transmitted from the cymbal 10 to the sensor attaching part 20.

Moreover, the separation distance between the first abutting part 21 and the second abutting part 22 is maintained by the insertion part 23. When the cymbal 10 is hit and tilts, the separation distance between the first abutting part 21 and the second abutting part 22 can remain unchanged. Thus, the piezo sensor 50 adhered to the bottom side of the first abutting part 21 is not affected by the deformation caused by the tilt of the cymbal 10 being hit. As a result, damage to the piezo sensor 50, which occurs when the cymbal 10 is strongly hit, is prevented. In addition, the sensor attaching part 20 is hollow inside, which provides a space for the piezo sensor 50 to vibrate without hindrance. Accordingly, the vibration caused by the hit of the cymbal 10 can be accurately transmitted to the sensor attaching part 20.

Figure 5:
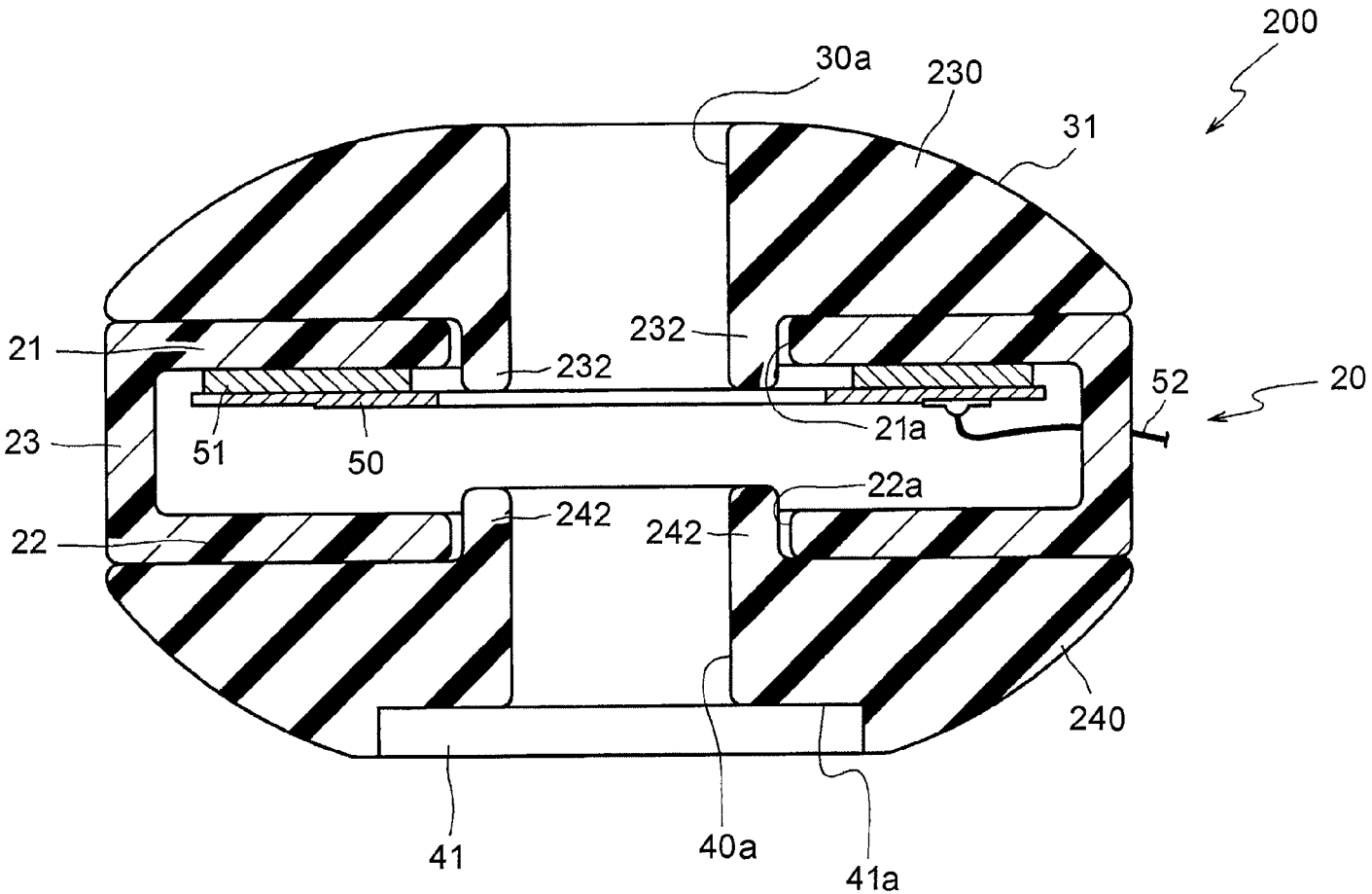
FIG. 5 is a cross-sectional view of a pickup according to a second embodiment of the invention.

Next, the second embodiment of the invention is explained below referring to FIG. 5. In the first embodiment, the inner sidewalls of the first axial hole 30*a* of the first buffer part 30 and the second axial hole 40*a* of the second buffer part 40 are positioned inward relative to the inner sidewalls of the first insertion hole 21*a* of the first abutting part 21 and the second insertion hole 22*a* of the second abutting part 22, so as to prevent the first abutting part 21 and the second abutting part 22 from abutting the rod 5. In the second embodiment, a first buffer part 230 and a second buffer part 240 respectively include a first protruding part 232 and a second protruding part 242 for preventing the first abutting part 21 and the second abutting part 22 from abutting the rod 5. It is noted that the elements the same as those in the first embodiment are assigned with the same reference numbers, and the detailed descriptions thereof are not repeated here. FIG. 5 corresponds to FIG. 3 that illustrates the first embodiment.

As shown in FIG. 5, a pickup 200 mainly includes the sensor attaching part 20, the first buffer part 230 and the second buffer part 240. The first buffer part 230 abuts the top side of the first abutting part 21 of the sensor attaching part 20. The second buffer part 240 abuts the bottom side of the second abutting part 22 of the sensor attaching part 20.

When the rod 5 (FIG. 4A) is inserted into the pickup 200, the first buffer part 230 is inserted between the cymbal 10 (FIG. 4A) and the sensor attaching part 20. The first buffer part 230 is formed of an elastic material that is relatively hard and has greater elasticity than the sensor attaching part 20. The first buffer part 230 includes the first axial hole 30*a*, the cymbal abutting surface 31 and a first protruding part 232. The first protruding part 232 protrudes downward from the edge section of the first axial hole 30*a* on the bottom side (the lower side of FIG. 5) of the first buffer part 230.

The first protruding part 232 has a cylindrical shape for preventing the first abutting part 21 of the sensor attaching part 20 from abutting the rod 5. The outer diameter of the first protruding part 232 is set smaller than the inner diameter of the first insertion hole 21*a* of the first abutting part 21. The inner sidewall of the first protruding part 232 is connected with the inner sidewall of the first axial hole 21*a* to form a surface. The height of the first protruding part 232 from the bottom side of the first buffer part 230 is set greater than the thickness (the dimension in the vertical direction of FIG. 5) of the first abutting part 21 of the sensor attaching part 20. Thus, the first protruding part 232 can be inserted through the first insertion hole 21*a* by coaxially disposing the bottom side of the first buffer part 230 on the top side of the first abutting part 21.

When the rod 5 is inserted into the pickup 200, the second buffer part 240 is inserted between the washer 8 (see FIG. 4A) and the sensor attaching part 20. The second buffer part 240 is formed of an elastic material having greater elasticity than the first buffer part 230. The second buffer part 240 includes the second axial hole 40*a*, the washer receiving part 41 and the second protruding part 242. The second protruding part 242 protrudes upward from the edge section of the second axial hole 40*a* on the top side (the upper side of FIG. 5) of the second buffer part 240.

The second protruding part 242 has a cylindrical shape for preventing the second abutting part 22 of the sensor attaching part 20 from abutting the rod 5. The outer diameter of the second protruding part 242 is set smaller than the inner diameter of the second insertion hole 22*a* of the second abutting part 22. The inner sidewall of the second protruding part 242 is connected with the inner sidewall of the second axial hole 22*a* to form a surface. The height of the second protruding part 242 from the top side of the second buffer part 240 is set greater than the thickness (dimension in the vertical direction of FIG. 5) of the second abutting part 22 of the sensor attaching part 20. Accordingly, the second protruding part 242 can be inserted into the second insertion hole 22*a* by coaxially disposing the top side of the second buffer part 240 on the bottom side of the second abutting part 22.

Based on the above, when the rod 5 is inserted into the pickup 200, the first protruding part 232 of the first buffer part 230 and the second protruding part 242 of the second buffer part 240 are inserted between the rod 5 and the first insertion hole 21*a* of the first abutting part 21 and the second insertion hole 22*a* of the second abutting part 22. Thus, given that the rod 5 moves in the circumferential direction relative to the pickup 200, the first protruding part 232 and the second protruding part 242 can abut against the rod 5, and the first abutting part 21 and the second abutting part 22 can be prevented from abutting the rod 5. Accordingly, a problem that the piezo sensor 50 may detect the vibration of the sensor attaching part 20 occurring when the sensor attaching part 20 abuts the rod 5 is prevented.

Further, it is also possible to set the outer diameters of the first protruding part 232 and the second protruding part 242 greater than the inner diameters of the first insertion hole 21*a* of the first abutting part 21 and the second insertion hole 22*a* of the second abutting part 22, and push the first protruding part 232 and the second protruding part 242 into the first insertion hole 21*a* and the second insertion hole 22*a* respectively, so as to prevent the first buffer part 230 and the second buffer part 240 from sliding relative to the sensor attaching part 20. In that case, the first buffer part 230 and the second buffer part 240 do not need to be adhered to the sensor attaching part 20. Thus, the production costs of the pickup 200 can be reduced.

Figure 6:
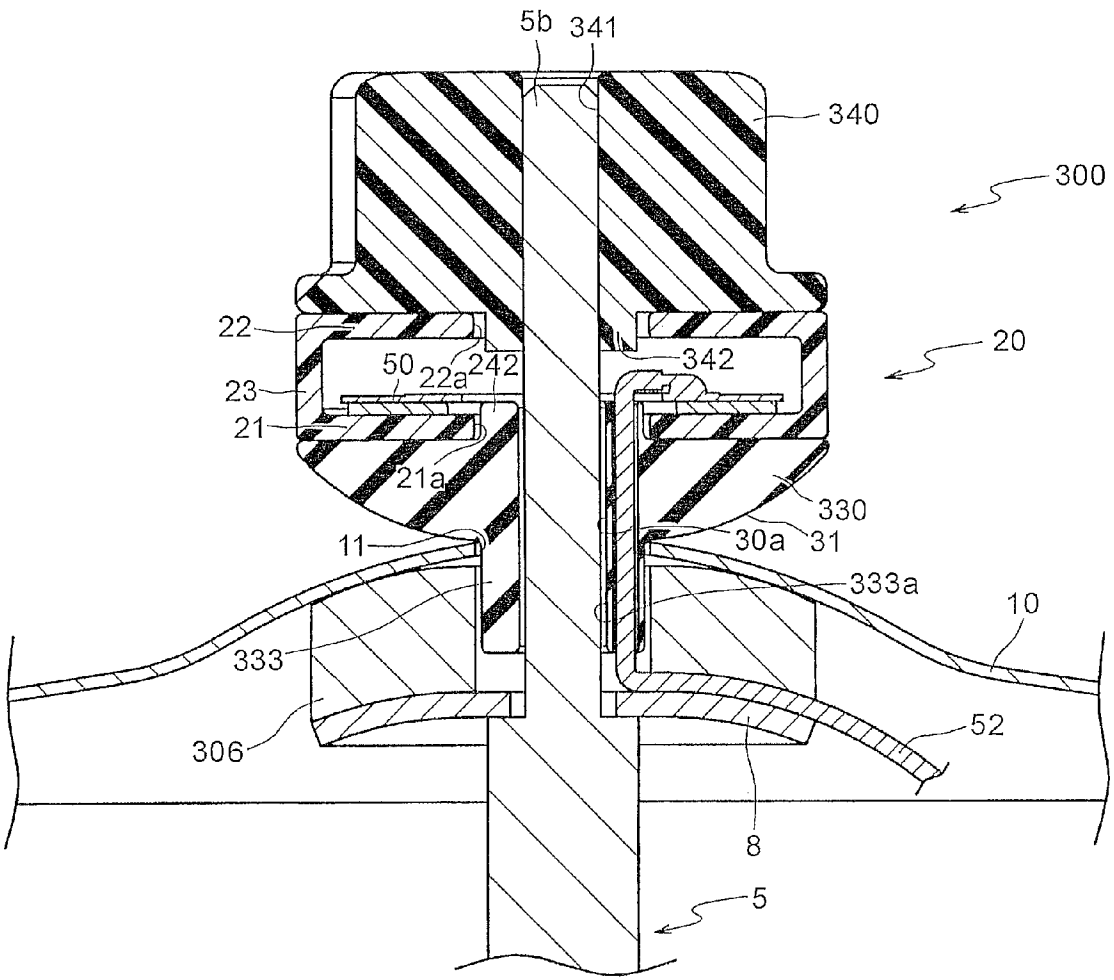
FIG. 6 is a partial cross-sectional view of a cymbal stand according to a third embodiment of the invention.

Next, the third embodiment is explained with reference to FIG. 6. The first embodiment illustrates that the pickup 100 abuts the cymbal 10 from below. In the third embodiment, a pickup 300 abuts the cymbal 10 from above. It is noted that the elements the same as those in the first embodiment are assigned with the same reference numbers, and detailed descriptions thereof are not repeated hereinafter. FIG. 6 is a schematic cross-sectional view along the axial direction of the rod 5.

As shown in FIG. 6, the pickup 300 includes the sensor attaching part 20, a first buffer part 330 and a knob 340. The first buffer part 330 abuts the first abutting part 21 of the sensor attaching part 20. The knob 340 abuts the second abutting part 22 of the sensor attaching part 20.

When the rod 5 is inserted into the pickup 300, the first buffer part 330 is inserted between the cymbal 10 and the sensor attaching part 20. The first buffer part 330 is formed of a relatively hard elastic material with greater elasticity than the sensor attaching part 20. The first buffer part 330 includes the first axial hole 30*a*, the cymbal abutting surface 31, the first protruding part 232 and a cable guiding part 333. The cable guiding part 333 protrudes downward (the lower side of FIG. 6) from the edge section of the first axial hole 30*a* on the cymbal abutting surface 31. The cable guiding part 333 has a cylindrical shape for guiding the other end of the cable 52 connected to the piezo sensor 50 to the outside of the sensor attaching part 20.

Moreover, a cable passage 333*a* is formed through the first buffer part 330 along the axial direction of the first axial hole 30*a* from a protruding end of the first protruding part 232 to a protruding end of the cable guiding part 333. The cable 52 is inserted through the cable passage 333*a*. Thus, the inside of the sensor attaching part 20 communicates with the outside of the same via the cable passage 333*a*, so that the other end of the cable 52 can be disposed outside of the sensor attaching part 20.

Further, the outer diameter of the cable guiding part 333 is set smaller than the inner diameter of the hole 11 of the cymbal 10 and the inner diameter of the inner sidewall of the cushion material 306. The cushion material 306 is formed of felt and has a ring shape for the rod 5 to pass. The inner sidewall of the cable guiding part 333 is connected with the inner sidewall of the first axial hole 30*a* to form a surface. The height of the cable guiding part 333 from the cymbal abutting surface 31 is set greater than the thickness (dimensions in the vertical direction of FIG. 6) of the cymbal 10.

The knob 340 is used to fasten the pickup 300 to the rod 5 and is formed of an ABS resin. The knob 340 includes a female-threaded hole 341 and a knob protruding part 342. The threaded hole 341 is formed through the knob 340 along the thickness direction (the vertical direction of FIG. 6) of the knob 340. The knob protruding part 342 protrudes downward from the edge section of the female-threaded hole 341 on the bottom side (the lower side of FIG. 6) of the knob 340.

The female-threaded hole 341 is for screwing the knob 340 onto a male thread formed on the outer peripheral surface of the rod 5. A female thread is formed on the inner sidewall of the hole 341 to match the male thread on the rod 5.

The knob protruding part 342 has a cylindrical shape preventing the second abutting part 22 of the sensor attaching part 20 from abutting the rod 5. The outer diameter of the knob protruding part 342 is set smaller than the inner diameter of the second insertion hole 22*a* of the second abutting part 22. In addition, the inner sidewall of the knob protruding part 342 is connected with the inner sidewall of the female-threaded hole 341. Moreover, the height of the knob protruding part 342 from the bottom side of the knob 340 is greater than the thickness (dimension in the vertical direction of FIG. 6) of the second abutting part 22 of the sensor attaching part 20.

Thus, as the rod 5 is inserted through the pickup 300, the knob protruding part 342 of the knob 340 is inserted between the rod 5 and the second insertion hole 22*a* of the second abutting part 22. When the rod 5 moves in a circumferential direction relative to the pickup 300, the knob protruding part 342 abuts the rod 5. That is, the second abutting part 22 is prevented from abutting the rod 5. Thus, a problem that the piezo sensor 50 may detect the vibration of the sensor attaching part 20 occurring when the sensor attaching part 20 abuts the rod 5 is prevented.

After the rod 5 is inserted through the cymbal 10, the rod 5 passes through the pickup 300 in a state that the cymbal abutting surface 31 of the first buffer part 330 faces toward the top side of the cymbal 10. In addition, the rod 5 is screwed and fastened to the female-threaded hole 341 of the knob 340. As a result, the cushion material 306, the cymbal 10 and the pickup 300 are fixed to the rod 5.

In comparison with using an additional fastening member to fix the cymbal 10 and the pickup 300, the process of fixing the cymbal 10 and the pickup 300 to the rod 5 is simplified in this embodiment.

In addition, by inserting the cable 52 through the cable guiding part 333 of the first buffer part 330, the cable 52 is prevented from damage caused by the contact of the cymbal 10 or the fastening force of the knob 340.

Figure 7B:
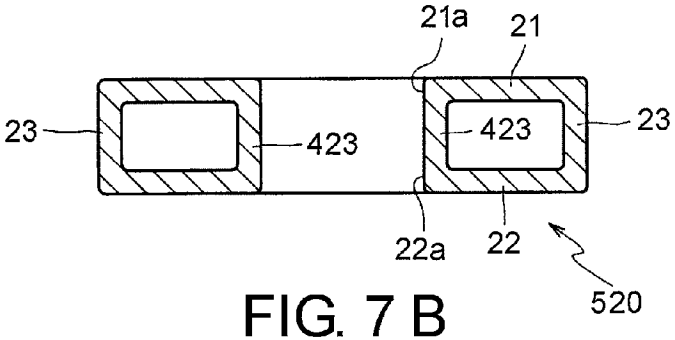
FIG. 7B is a cross-sectional view of a sensor attaching part of a pickup according to a fifth embodiment of the invention.
Figure 7A:
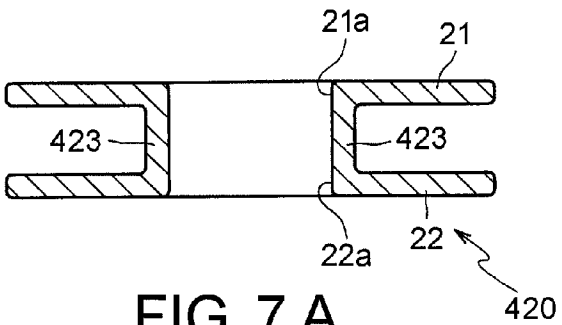
FIG. 7A is a cross-sectional view of a sensor attaching part of a pickup according to a fourth embodiment of the invention.

Next, the fourth embodiment of the invention is explained below referring to FIG. 7A. The first embodiment illustrates that the insertion part 23 of the sensor attaching part 20 connects the outer peripheral edge on the bottom side of the first abutting part 21 and the outer peripheral edge on the top side of the second abutting part 22. In the fourth embodiment, an insertion part 423 of a sensor attaching part 420 connects the edge section of the first insertion hole 21*a* on the bottom side of the first abutting part 21 and the edge section of the second insertion hole 22*a* on the top side of the second abutting part 22. It is noted that the elements the same as those in the first embodiment are assigned with the same reference numbers, and detailed descriptions thereof are not repeated hereinafter. FIG. 7A corresponds to FIG. 3 which illustrates the first embodiment.

As shown in FIG. 7A, the sensor attaching part 420 includes the first abutting part 21, the second abutting part 22 and the insertion part 423. The insertion part 423 connects the edge section of the first insertion hole 21*a* on the bottom side (the lower side of FIG. 7A) of the first abutting part 21 and the edge section of the second insertion hole 22*a* on the top side (the upper side of FIG. 7A) of the second abutting part 22.

The insertion part 423 has a cylindrical shape that maintains the separation distance between the first abutting part 21 and the second abutting part 22. The inner sidewall of the insertion part 423 is connected with the inner sidewalls of the first insertion hole 21*a* of the first abutting part 21 and the second insertion hole 22*a* of the second abutting part 22 to form a surface. The first abutting part 21 and the second abutting part 22 are prevented from being pushed close to each other by the insertion part 423. Accordingly, the separation distance between the first abutting part 21 and the second abutting part 22 can be maintained.

Next, referring to FIG. 7B, the fifth embodiment of the invention is explained below. The first embodiment illustrates that the insertion part 23 of the sensor attaching part 20 connects the outer peripheral edge on the bottom side of the first abutting part 21 and the outer peripheral edge on the top side of the second abutting part 22. In the fifth embodiment, the insertion part 23 of a sensor attaching part 520 connects the outer peripheral edge on the bottom side of the first abutting part 21 and the outer peripheral edge on the top side of the second abutting part 22. In addition, according to the fifth embodiment, the sensor attaching part 520 further includes the insertion part 423 which connects the edge section of the first insertion hole 21*a* on the bottom side of the first abutting part 21 and the edge section of the second insertion hole 22*a* on the top side of the second abutting part 22. It is noted that the elements the same as those in the first embodiment are assigned with the same reference numbers, and detailed descriptions thereof are not repeated hereinafter. FIG. 7B corresponds to FIG. 3 which illustrates the first embodiment.

As shown in FIG. 7B, the sensor attaching part 520 includes the first abutting part 21, the second abutting part 22, the insertion part 23 and the insertion part 423. Accordingly, the insertion part 23 and the insertion part 423 prevent the first abutting part 21 and the second abutting part 22 from being pushed close to each other. Therefore, the separation distance between the first abutting part 21 and the second abutting part 22 can be maintained.

The inside of the sensor attaching part 520, i.e., the space surrounded by the first abutting part 21, the second abutting part 22, the insertion part 23 and the insertion part 423, is sealed. Therefore, dust can be prevented from attaching to the piezo sensor 50 (see FIG. 3) inside the sensor attaching part 520, and the piezo sensor 50 cannot be touched from outside the sensor attaching part 520. Accordingly, it is difficult to damage the piezo sensor 50.

Furthermore, the sensor attaching part 520 includes the insertion part 23, which connects the outer peripheral edges of the first abutting part 21 and the second abutting part 22, and the insertion part 423, which connects the edge sections of the first insertion hole 21*a* and the second insertion hole 22*a*. Thereby, the first abutting part 21 and the second abutting part 22 are firmly supported.

Next, the sixth embodiment of the invention is explained below with reference to FIGS. 7C-7D. The first embodiment shows that the insertion part 23 of the sensor attaching part 20 connects the entirety of the outer peripheral edge on the bottom side of the first abutting part 21 and the entirety of the outer peripheral edge on the top side of the second abutting part 22. According to the sixth embodiment, a sensor attaching part 620 includes a plurality of insertion parts 623 that connects a portion of the outer peripheral edge on the bottom side of the first abutting part 21 and a portion of the outer peripheral edge on the top side of the second abutting part 22. It is noted that the elements the same as those in the first embodiment are assigned with the same reference numbers, and detailed descriptions thereof are not repeated.

Figure 7D:
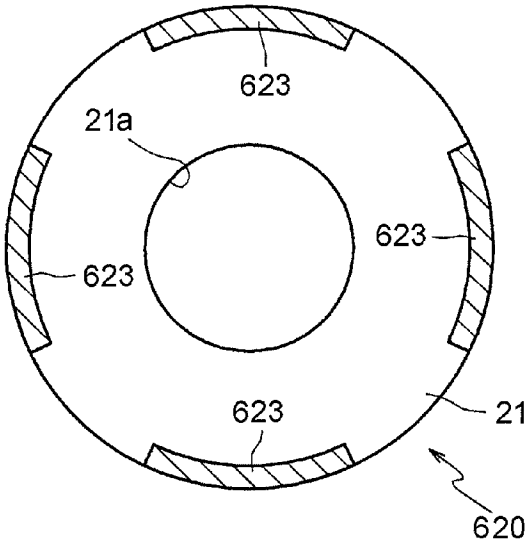
FIG. 7D is a cross-sectional view of the sensor attaching part of FIG. 7C along the VIId-VIId line.
Figure 7C:
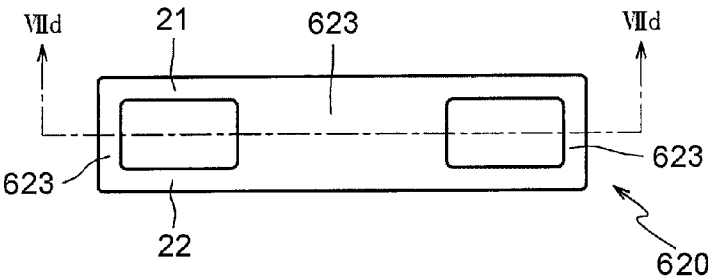
FIG. 7C is a front view of a sensor attaching part of a pickup according to the sixth embodiment of the invention.

As shown in FIGS. 7C-7D, the sensor attaching part 620 includes the first abutting part 21, the second abutting part 22, and the insertion parts 623 inserted between the first abutting part 21 and the second abutting part 22.

The insertion parts 623 are curved plate-shaped members that maintain the separation distance between the first abutting part 21 and the second abutting part 22, disposed with an equal space therebetween along a circumferential direction. The four insertion parts 623 connect a portion of the outer peripheral edge on the bottom side (the lower side of FIG. 7C) of the first abutting part 21 and a portion of the outer peripheral edge on the top side (upper side of FIG. 7C) of the second abutting part 22. Thus, given that a force is applied in a direction to push the first abutting part 21 and the second abutting part 22 close to each other, the separation distance between the bottom side of the first abutting part 21 and the top side of the second abutting part 22 can be maintained. Further, the multiple insertion parts 623 only connect a part of the outer peripheral edge on the bottom side of the first abutting part 21 and a part of the outer peripheral edge on the top side of the second abutting part 22. Thus, as compared to a case of connecting the entire outer peripheral edge on the bottom side of the first abutting part 21 and the entire outer peripheral edge on the top side of the second abutting part 22, the material cost of the sensor attaching part 620 is reduced.

Though the invention has been disclosed above by the embodiments, the invention should not be construed as limited to the aforementioned embodiments. It is apparent that various modifications and alterations may be made without departing from the spirit of the invention.

For example, though the piezo sensor 50 has a ring shape in the above embodiments, the invention is not limited thereto. A film- or disc-shaped piezo sensor can also be used instead. An electromagnetic inductive sensor or an electrostatic capacitance sensor can also be used to replace the piezo sensor 50.

Though the pickups 100, 200 and 300 are used to detect the vibration of the cymbal 10, i.e., a so-called acoustic cymbal, in the above embodiments, the invention is not limited thereto. The pickups 100, 200 and 300 are also applicable to an electronic cymbal. To be more specific, the pickups 100, 200 and 300 can be used as trigger sensors to detect the vibration of a percussion instrument hit by the player.

Though the first abutting part 21 and the second abutting part 22 of the sensor attaching parts 20, 420, 520 and 620, the first buffer parts 30, 230 and 330, the second buffer parts 40 and 240, the cushion materials 6 and 306, and the washer 8 respectively have a ring shape in the above embodiments, the invention is not limited thereto. The first abutting part 21 and the second abutting part 22 of the sensor attaching parts 20, 420, 520 and 620, the first buffer parts 30, 230 and 330, the second buffer parts 40 and 240, the cushion materials 6 and 306, and the washer 8 can also be approximately C-shaped. Accordingly, the pickups 100, 200 and 300, the cushion materials 6 and 306, and the washer 8 can be installed in a direction perpendicular to the axial direction of the rod 5 as being installed onto the rod 5. Since the pickups 100, 200 and 300, the cushion materials 6 and 306, and the washer 8 are detachable from the rod 5 while the rod 5 remains inserted into the cymbal 10, the process of attaching these members to the rod 5 is simplified.

Though the second buffer parts 40 and 240 respectively include the washer receiving part 41 in the first and the second embodiments, the invention is not limited thereto. The washer receiving part 41 can be omitted to simplify the shapes of the second buffer parts 40 and 240 and to reduce the production costs of the second buffer parts 40 and 240. In such a case, a mark can be put on the pickups 100 and 200 to indicate the top or the bottom side, so that the pickups 100 and 200 can be put in the correct direction to be disposed on the rod 5.

In addition, a member formed of an ABS resin, etc., which is harder than the second buffer parts 40 and 240, can be integrally disposed on the bottom side (the side opposite to the surface abutting the second abutting part 22) of the second buffer parts 40 and 240. Thereby, it is not required to prepare the washer 8 separately. Moreover, when the pickup 100 or 200 is fixed to the rod 5, a process of inserting the rod 5 through the washer 8 can be omitted. Therefore, the process of fixing the pickup 100 or 200 to the rod 5 can be simplified.

Though the piezo sensor 50 is attached to the bottom side of the first abutting part 21 of the sensor attaching parts 20, 420, 520 and 620, which is close to the cymbal 10, in the above embodiments, the invention is not limited thereto. The piezo sensor 50 can be attached to the top side of the second abutting part 22. Thus, the piezo sensor 50 can be carried by the top side of the second buffer part 22 when the sensor attaching parts 20, 420, 520 and 620 are fixed to the rod, and the piezo sensor 50 attached to the sensor attaching parts 20, 420, 520 and 620 would not easily peel off the sensor attaching parts 20, 420, 520, and 620 due to gravity.

Though the sensor attaching parts 20, 420, 520, and 620 are hollow inside in the above embodiments, the invention is not limited thereto. The sensor attaching parts 20, 420, 520 and 620 can further include cotton or sponge, etc., inside, which not only allows the piezo sensor 50 to vibrate but also quickly absorbs the residual vibration of the sensor attaching parts 20, 420, 520 and 620 after the cymbal 10 is hit. In addition, a vibration absorbing member, such as a butyl rubber, can be attached to the top side of the second abutting part 22 inside the sensor attaching parts 20, 420, 520 and 620, so as to quickly absorb the vibration of these sensor attaching parts.

Though the invention is used for detecting the vibration of one piece of cymbal 10 fixed to the rod 5 in the above embodiments, the invention is not limited thereto. The invention is also applicable to hi hat cymbals. In the case of hi hat cymbals, the cymbal abutting surface 31 of the first buffer part 30, 230 or 330 of the pickups 100, 200 or 300 is disposed abutting the upper cymbal for detecting the vibration of the hit on the hi hat cymbals.

Though the first insertion hole 21*a* of the first abutting part 21, the second insertion hole 22*a* of the second abutting part 22, the first axial hole 30*a* of the first buffer parts 30, 230 and 330, and the second axial hole 40*a* of the second buffer parts 40 and 240 are circular in the above embodiments, the invention is not limited thereto. The aforementioned holes can also be polygonal.

Though the first buffer parts 30, 230 and 330 and the second buffer parts 40 and 240 are formed of elastic materials in the above embodiments, the invention is not limited thereto. The first buffer part and the second buffer part can alternatively be formed of felt. When the second buffer part is formed of felt, the vibration transmitted from the floor to the second buffer part via the rod can be easily reduced. Thus, the vibration transmitted from the floor to the sensor attaching parts 20, 420, 520 or 620 is inhibited. When the first buffer part is formed of felt, the first buffer part becomes harder when compressed by the fastening force of the fastening member 7 or the knob 340. Thus, the damping of the vibration transmitted from the cymbal 10 to the sensor attaching parts 20, 420, 520, and 620 is inhibited.

When the first buffer part is formed of an elastic material and the second buffer part is formed of felt, the vibration transmitted from the floor to the second buffer part via the rod 5 and the washer 8 can be easily reduced, and the damping of the vibration transmitted from the cymbal 10 to the first buffer part can be inhibited. Thus, the vibration transmitted from floor to the sensor attaching part 20, 420, 520 or 620 is reduced, and the damping of the vibration transmitted from the cymbal 10 to the sensor attaching part 20, 420, 520 or 620 is inhibited. Thus, the vibration caused by the hit on the cymbal 10 can be easily and accurately transmitted to the sensor attaching parts 20, 420, 520 or 620.

Though the first buffer part 230 or 330 and the second buffer part 240 or the knob 340 respectively include the first protruding part 232 and the second protruding part 242 or knob protruding part 342 in the second or third embodiment, the invention is not limited thereto. The first protruding part 232 or the second protruding part 242 or the knob protruding part 342 can be disposed on one side of the first buffer part 230 or 330 or the second buffer part 240 or the knob 340, and the first protruding part 232 or the second protruding part 242 or knob protruding part 342 on the other side can be omitted. Thus, the shape of the first buffer parts 230 and 330 or the second buffer part 240 or the knob 340 can be simplified to reduce the fabrication costs.

In such a case, when being inserted into the first insertion hole 21*a* or the second insertion hole 22*a* of the sensor attaching parts 20, 420, 520 or 620, the first protruding part 232 or the second protruding part 242 or the knob protruding part 342 formed on one side of the first buffer part 230 or 330 or the second buffer part 240 or the knob 340 is preferably inserted between the rod 5 and the inner sidewalls of the first insertion hole 21*a* and the second insertion hole 22*a*. Thus, the rod 5 is prevented from abutting the sensor attaching parts 20, 420, 520 or 620.

Though the pickup 300 includes the knob 340 in the third embodiment, the invention is not limited thereto. The pickup can include the second buffer part 40 instead of the knob 340, and the pickup, the cymbal 10 and the cushion material 306 can be fixed to the rod 5 via the washer 8 and the fastening member 7.

What is claimed is:

1. A cymbal pickup, comprising:

a sensor detecting a vibration of a cymbal, wherein the cymbal has, through a center thereof, a hole that allows a stick-shaped rod to be inserted through; and a sensor attaching part to which the sensor is attached, the sensor attaching part having a predetermined hardness and comprising:

a first abutting part having a first insertion hole which allows the rod to pass through;

a second abutting part configured opposite to a side of the first abutting part and having a second insertion hole which allows the rod that is inserted into the first insertion hole to pass through; and an insertion part configured between the first abutting part and the second abutting part to maintain a separation distance between the side of the first abutting part and a side of the second abutting part opposite thereto, wherein the sensor is attached to the side of the first abutting part or the side of the second abutting part, and wherein when the rod is inserted through the cymbal and the cymbal pickup, the cymbal pickup abuts the cymbal and is fixed together with the cymbal to detect the vibration of the cymbal.

2. The cymbal pickup according to claim 1, further comprising:

a first buffer part abutting the other side of the first abutting part and comprising a material with a greater elasticity than an elasticity of the sensor attaching part; and a second buffer part abutting the other side of the second abutting part and comprising a material with a greater elasticity than an elasticity of the sensor attaching part;

wherein the first buffer part comprises a first axial hole which allows the rod that is inserted into the first insertion hole of the first abutting part to pass through, and the second buffer part comprises a second axial hole which allows the rod that is inserted into the second insertion hole of the second abutting part to pass through.

3. The cymbal pickup according to claim 2, wherein the first buffer part comprises a first elastic material, and the second buffer part comprises a second elastic material with a greater elasticity than an elasticity of the first buffer part.

4. The cymbal pickup according to claim 1, further comprising:

a first buffer part abutting the other side of the first abutting part and comprising a material with a greater elasticity than an elasticity of the sensor attaching part; and a knob abutting the other side of the second abutting part;

wherein the first buffer part comprises a first axial hole which allows the rod that is inserted into the first insertion hole of the first abutting part to pass through, and the knob comprises a second axial hole with a female thread which matches a male thread formed on the rod that is inserted into the second insertion hole of the second abutting part.

5. The cymbal pickup according to claim 1, wherein the sensor is attached to the side of the first abutting part.

6. The cymbal pickup according to claim 2, wherein when the first buffer part and the second buffer part or the knob are attached to the sensor attaching part, an inner sidewall of the first axial hole of the first buffer part and an inner sidewall of the second axial hole of the second buffer part or the knob are positioned inward relative to an inner sidewall of the first insertion hole of the first abutting part and an inner sidewall of the second insertion hole of the second abutting part.

7. The cymbal pickup according to claim 2, wherein the first buffer part, or the second buffer part or the knob, further comprises a protruding part on at least one side thereof, and the protruding part protrudes from a surface of the first buffer part or the second buffer part or the knob, which abuts the first abutting part or the second abutting part; and wherein the protruding part is smaller than the first insertion hole of the first abutting part and the second insertion hole of the second abutting part, so as to be inserted into the first insertion hole of the first abutting part or the second insertion hole of the second abutting part.

8. The cymbal pickup according to claim 2, wherein the first buffer part comprises a cymbal abutting surface which has a spherical shape and is configured on a side opposite to the surface that abuts the first abutting part.

9. The cymbal pickup according to claim 1, further comprising a hollow space between the first abutting part and the second abutting part.

10. The cymbal pickup according to claim 1, wherein the insertion part of the sensor attaching part connects an outer peripheral edge on a bottom side of the first abutting part and an outer peripheral edge on a top side of the second abutting part.

11. The cymbal pickup according to claim 1, wherein the insertion part of the sensor attaching part connects an edge section of the first insertion hole on a bottom side of the first abutting part and an edge section of the second insertion hole on a top side of the second abutting part.

12. The cymbal pickup according to claim 1, wherein the insertion part of the sensor attaching part connects an outer peripheral edge on a bottom side of the first abutting part and an outer peripheral edge on a top side of the second abutting part and further connects an edge section of the first insertion hole on the bottom side of the first abutting part and an edge section of the second insertion hole on the top side of the second abutting part.

13. The cymbal pickup according to claim 1, wherein the insertion part of the sensor attaching part connects a portion of an outer peripheral edge on a bottom side of the first abutting part and a portion of an outer peripheral edge on a top side of the second abutting part.

14. The cymbal pickup according to claim 13, wherein the sensor attaching part comprises a plurality of insertion parts that are configured with an equal space therebetween along a circumferential direction of the outer peripheral edges of the first abutting part and the second abutting part.

15. The cymbal pickup according to claim 8, wherein the cymbal abutting surface of the first buffer part abuts a bottom side of the cymbal.

16. The cymbal pickup according to claim 8, wherein the cymbal abutting surface of the first buffer part abuts a top side of the cymbal.

17. A stand, comprising:

the cymbal pickup according to claim 1; and a stick-shaped rod formed to be inserted into the cymbal pickup.

* * * * *